US007309248B2

(12) United States Patent
Sakamoto

(10) Patent No.: US 7,309,248 B2
(45) Date of Patent: Dec. 18, 2007

(54) CONNECTOR FIXING STRUCTURE FOR FIXING A CONNECTOR TO A BOARD

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/474,344

(22) Filed: Jun. 26, 2006

(65) Prior Publication Data

US 2007/0066117 A1 Mar. 22, 2007

(30) Foreign Application Priority Data

Jun. 27, 2005 (JP) ..... P2005-186433
Jul. 1, 2005 (JP) ..... P2005-193971

(51) Int. Cl.
*H01R 13/62* (2006.01)

(52) U.S. Cl. ..... 439/326; 439/570

(58) Field of Classification Search ..... 439/570, 439/326

See application file for complete search history.

(56) References Cited

U.S. PATENT DOCUMENTS 4,986,765 A * 1/1991 Korsunsky et al. ..... 439/326
5,112,242 A * 5/1992 Choy et al. ..... 439/326
5,123,857 A * 6/1992 Lee Chao ..... 439/326
5,161,995 A * 11/1992 Bakke et al. ..... 439/326
5,297,966 A * 3/1994 Brennian et al. ..... 439/64
5,334,049 A * 8/1994 Kachlic et al. ..... 439/567
5,372,518 A * 12/1994 Liu et al. ..... 439/326
6,824,413 B1 * 11/2004 Shipe et al. ..... 439/326
6,971,899 B1 * 12/2005 Liu ..... 439/326
7,074,079 B2 * 7/2006 Higuchi ..... 439/566

FOREIGN PATENT DOCUMENTS

JP 8-130055 A 5/1996
JP 10-21988 A 1/1998
JP 2000-252004 A 9/2000

* cited by examiner

*Primary Examiner*—Michael C. Zarroli
(74) *Attorney, Agent, or Firm*—Sughrue Mion, PLLC

(57) ABSTRACT

A connector fixing structure for fixing a connector 11 to a board 10 includes a fixing metal member 12, and the fixing metal member 12 includes a connector mounting piece portion 16 for mounting on the connector 11, and a board joining piece portion 17 which is formed integrally with the connector mounting piece portion 16, and extends therefrom so as to be disposed on the board 10 in parallel relation thereto, and is adapted to be soldered to a land 23 formed on the board 10. A hole portion 24 is formed in the land 23, and an insertion piece portion 21 for insertion into the hole portion 24 is formed at the fixing metal member 12, and this insertion piece portion is formed by stamping out part of the board joining piece portion 17 and then by bending the stamped-out portion. The insertion piece portion 21 is soldered to the hole portion 24.

5 Claims, 10 Drawing Sheets

CONNECTOR FIXING STRUCTURE FOR FIXING A CONNECTOR TO A BOARD

BACKGROUND OF THE INVENTION

1. Field of the Invention

This invention relates to a connector fixing structure for fixing a connector to a board.

2. Description of the related art

In a conventional connector fixing structure for fixing a connector to a board, generally, there are used fixing metal members 1 (as shown in FIG. 6 ) each formed by bending a band-like metal sheet into a generally L-shape. The fixing metal member 1 includes a connector mounting piece portion 3 for mounting on the connector 2, and a board joining piece portion 5 which is formed integrally at one edge of the connector mounting piece portion 3, and extends therefrom so as to be disposed on the board 4 in parallel relation thereto. The board joining piece portion 5 is soldered to a land formed on the board 4, so that the connector 2 is fixed to the board 4 (see, for example, JP-A-8-130055 Publication).

In recent years, because of a compact design of electronic devices and for other reasons, a mounting space available on the board 4 tends to be reduced, and the fixing metal member 1 for fixing the connector 2 to the board 4 is also required to have a compact design. However, there has been a fear that with such a compact design of the fixing metal member 1, the strength of joining of the fixing metal member 1 to the board 4 decreases, so that the strength of fixing of the connector 2 to the board 4 decreases.

SUMMARY OF THE INVENTION

This invention has been made in view of the above problem, and an object of the invention is to provide a connector fixing structure in which the strength of joining of a fixing metal member to a board is increased without increasing an area occupied by the fixing metal member on the board, thereby securing a sufficient strength of fixing of a connector to the board.

Also, this invention has been made in view of the above problem, and an object of the invention is to provide a connector-fixing structure in which the strength of joining of a fixing metal member to a board is increased, thereby securing a sufficient strength of fixing of a connector to the board.

The above object has been achieved by a connector fixing structure of the present invention having the following features.

According to the present invention, there is provided a connector fixing structure for fixing a connector to a board, characterized in that the structure comprises a fixing metal member, and the fixing metal member includes a connector mounting piece portion for mounting on the connector, and a board joining piece portion which is formed integrally with the connector mounting piece portion, and extends therefrom so as to be disposed on the board in parallel relation thereto, and is adapted to be soldered to a land formed on the board; and a hole portion is formed in the land, and an insertion piece portion for insertion into the hole portion is formed at the fixing metal member, and the insertion piece portion is formed by stamping out part of the board joining piece portion and then by bending the stamped-out portion; and the insertion piece portion is soldered to the hole portion.

In the above connector fixing structure, the insertion piece portion, stamped out of the board joining piece portion, is inserted into the hole portion in the land, and is soldered to this hole port-ion. Molten solder spreads in a generally tapering manner from the distal end of the insertion piece portion toward a bottom of the hole portion to form a fillet. Also, the solder creeps up a peripheral edge of a void portion (or hole), formed in the board joining piece portion as a result of stamping out the insertion piece portion, to form a fillet at this peripheral edge. Therefore, as compared with the case where the insertion piece portion is not formed, the area of joining of the solder to the board and the area of joining of the solder to the fixing metal member are increased by amounts corresponding respectively to these fillets, and therefore the strength of joining of the solder to the board and the strength of joining of the solder to the fixing metal member are increased, and therefore the strength of joining of the fixing metal member to the board through the solder can be increased.

Here, the insertion piece portion is stamped out of the board joining piece portion, and is bent, and therefore the area, occupied by the board joining piece portion (that is, the area occupied by the fixing metal member) on the board, will not become larger as compared with the case where the insertion piece portion is not formed.

Furthermore, the insertion piece portion of the fixing metal member and the hole portion in the land can be used as positioning means for positioning the connector relative to the board.

In the above connector fixing structure, preferably, convex portion for reducing a clearance between the hole portion and the insertion piece portion inserted in the hole portion is formed on the insertion piece portion. With this construction, a capillary action is caused to develop in a gap between the surface of the insertion piece portion and the inner surface of the hole portion so that the molten solder can easily penetrate to the distal end of the insertion piece portion, and besides when the connector is positioned relative to the board by the insertion piece portion and the hole portion as described above, a relative movement between the connector and the board can be made small.

In the above connector fixing structure, preferably, the convex portion is formed on other portion of the insertion piece portion than a distal end portion of the insertion piece portion. With this construction, when reducing the clearance between the hole portion and the insertion piece portion (inserted in this hole portion) by the convex portion, the easy insertion of the insertion piece portion into the hole portion can be effected.

In the connector fixing structure of the present invention, the strength of joining of the fixing metal member to the board can be increased without increasing the area occupied by the fixing metal member on the board, thereby securing a sufficient strength of fixing of the connector to the board.

Also, the above object has been achieved by a connector fixing structure of the present invention having the following features.

According to the present invention, there is provided a connector fixing structure for fixing a connector to a board, characterized in that the structure comprises a fixing metal member, and the fixing metal member includes a connector mounting piece portion for mounting on the connector, and a board joining piece portion which is formed integrally with the connector mounting piece portion, and extends therefrom so as to be disposed on the board in parallel relation thereto, and is adapted to be soldered to a land formed on the board; and the fixing metal member further includes a small piece portion which is disposed in an upstanding condition on the board, with a small gap formed between the small piece portion and an edge of the board joining piece portion; and the small piece portion, together with the board joining piece portion, is soldered to the land.

In the above connector fixing structure, the small piece portion (which is disposed in an upstanding condition on the board, with the small gap formed between the small piece portion and the edge of the board joining piece portion), together with the board joining piece portion, is soldered to the land. In this construction, molten solder penetrates into the small gap formed between the edge of the board joining piece portion and the small piece portion, and spreads to creep up the small piece portion to form a solder fillet having a sufficient height from the board. As compared with the case where the small piece portion is not formed, the area of joining of the solder to the fixing metal member is increased by an amount corresponding to this fillet, and therefore the strength of joining of the solder to the fixing metal member is increased, and therefore the strength of joining of the fixing metal member to the board through the solder is increased.

In the above connector fixing structure, preferably, a notch is formed in the board joining piece portion, and the small piece portion is disposed within the notch, with the small gap formed between the small piece portion and an inner edge of the notch. With this construction, the area, occupied by the fixing metal member on the board, will not increase although the small piece portion is formed on the fixing metal member.

In the connector fixing structure of the present invention, the strength of joining of the fixing metal member to the board can be increased, thereby securing a sufficient strength of fixing of the connector to the board.

DESCRIPTION OF THE PREFERRED EMBODIMENTS

A preferred embodiment of a connector fixing structure of the present invention will now be described in detail with reference to the drawings.

Figure 1:
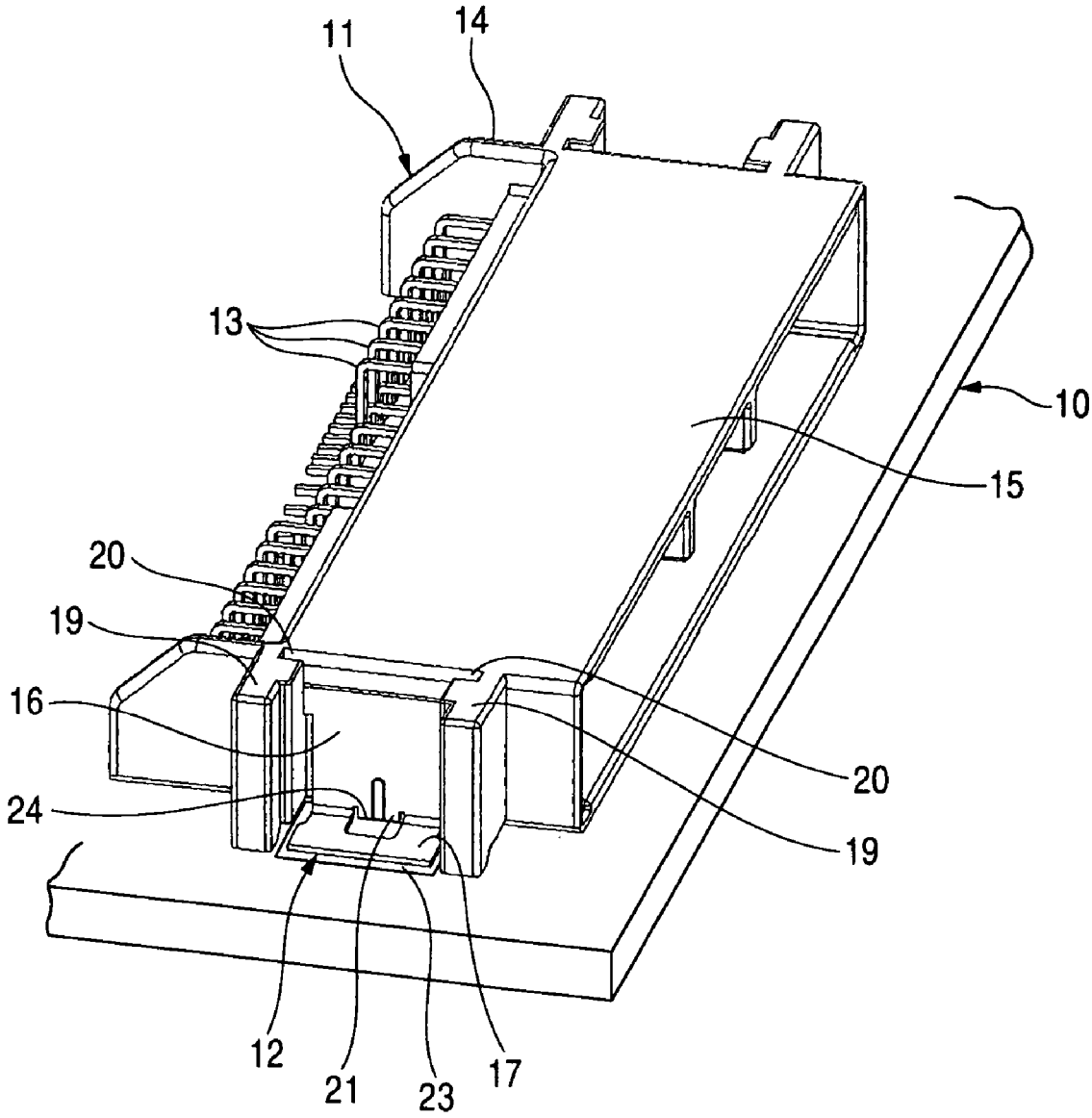
FIG. 1 is a perspective view of a first embodiment of a connector fixing structure of the present invention.
Figure 2:
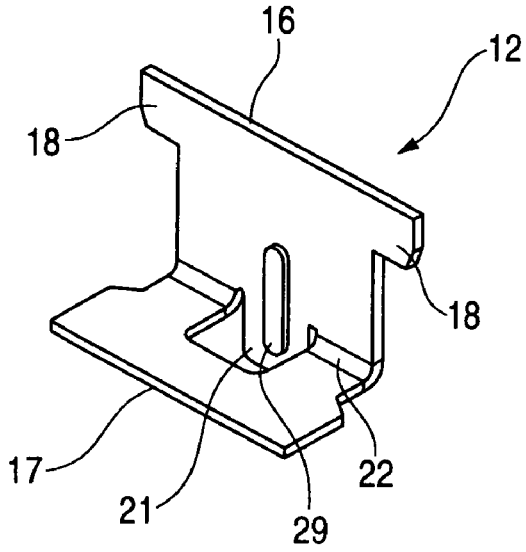
FIGS. 2A and 2B are perspective views showing a fixing metal member as seen from different angles, respectively.
Figure 2:
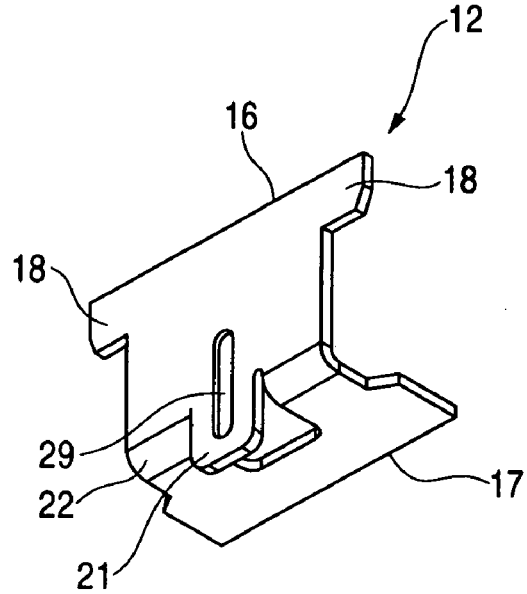
Figure 3:
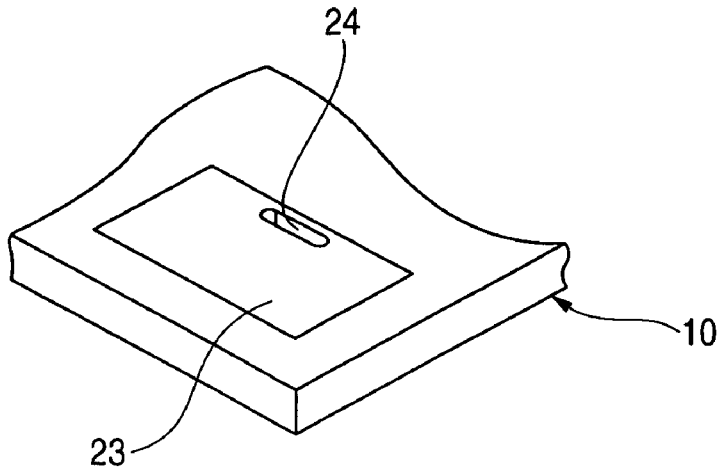
FIG. 3 is a perspective view of a land formed on a board.
Figure 4:
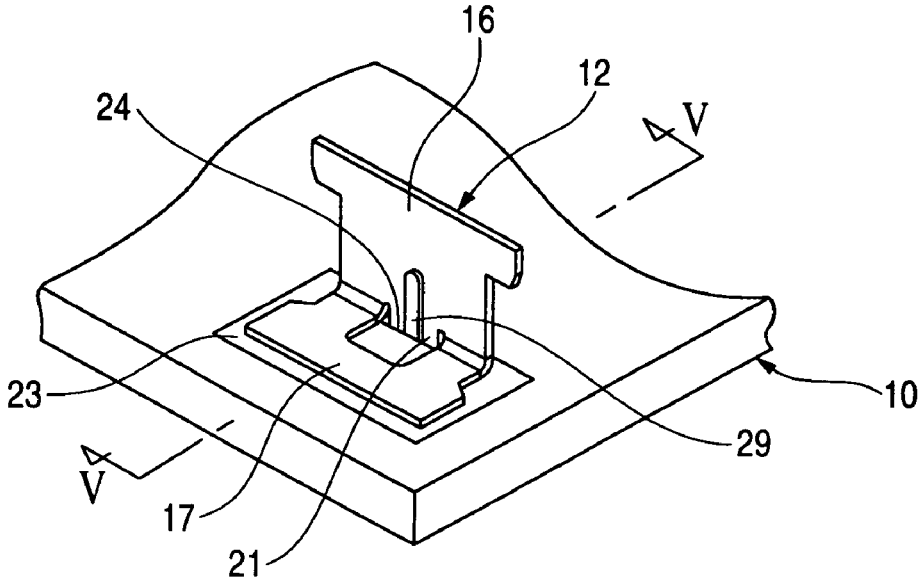
FIG. 4 is a perspective view showing the mounting of the fixing metal member on the land.
Figure 5:
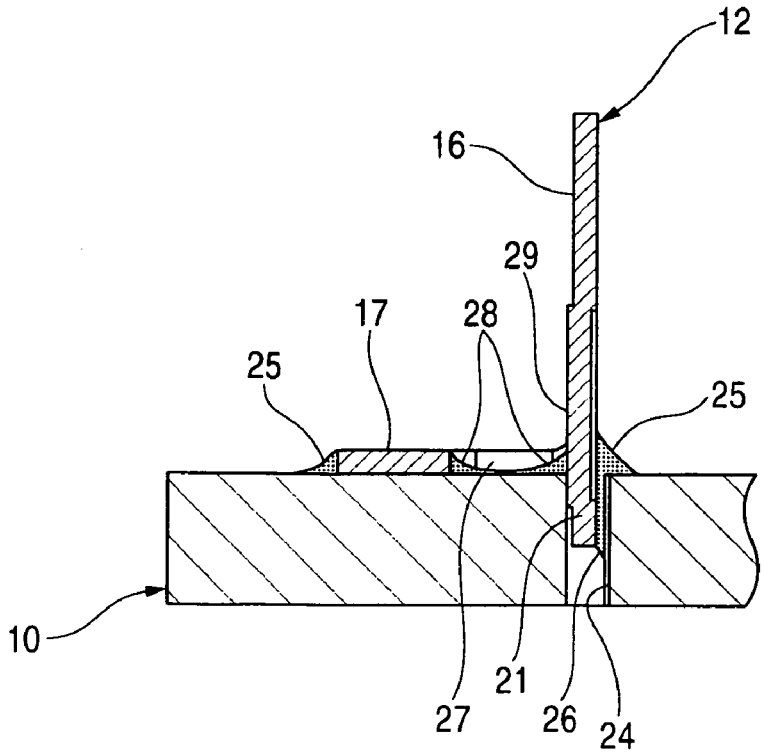
FIG. 5 is a cross-sectional view taken along the line V-V of FIG. 4.
Figure 6:
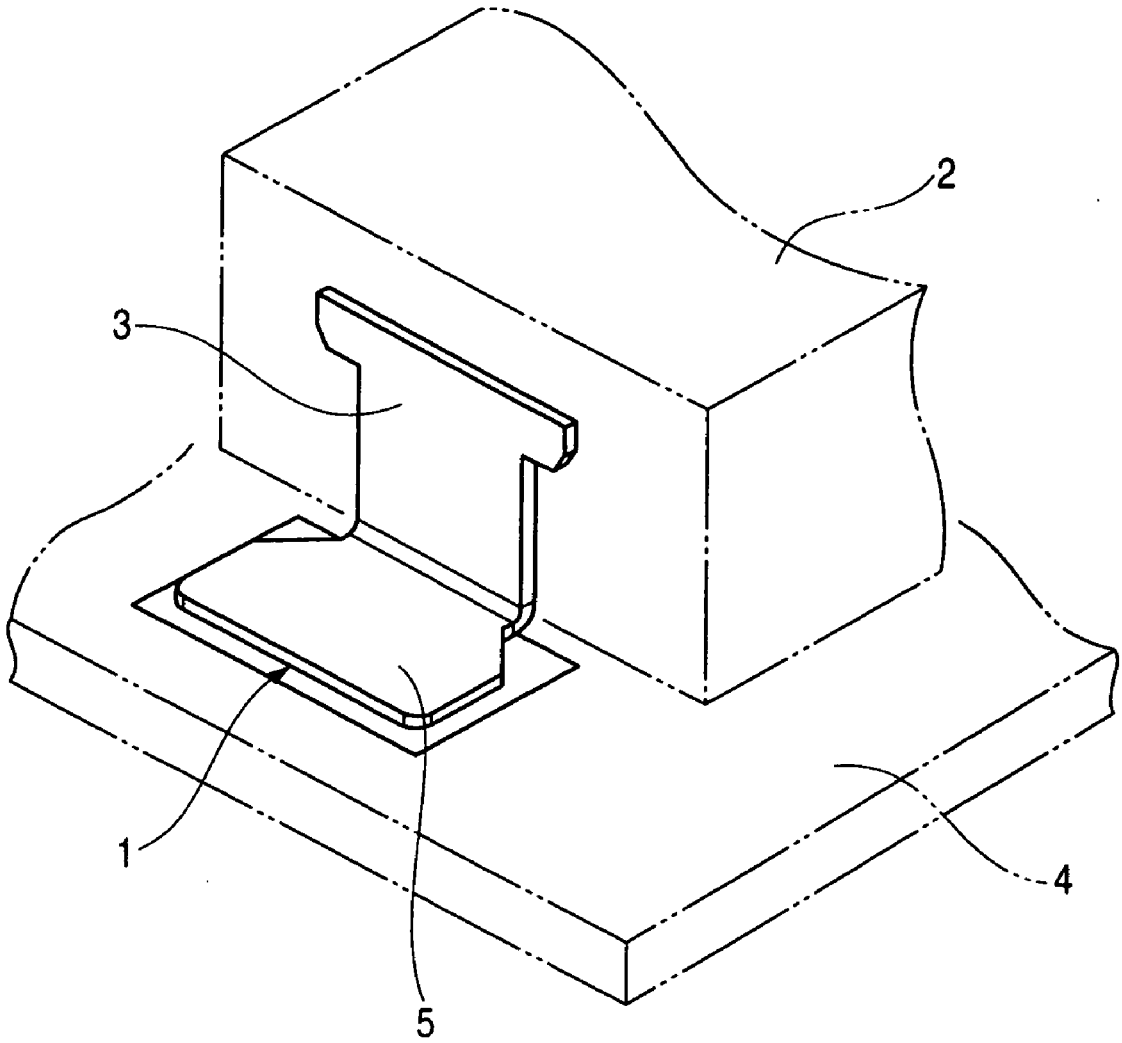
FIG. 6 is a perspective view showing a conventional connector fixing structure.

FIG. 1 is a perspective view of the first embodiment of the connector fixing structure of the invention, FIGS. 2A and 2B are perspective views showing a fixing metal member, FIG. 3 is a perspective view showing a land formed on a board, FIG. 4 is a perspective view showing the mounting of the fixing metal member on the land, and FIG. 5 is a cross-sectional view taken along the line V-V of FIG. 4.

Figure 7:
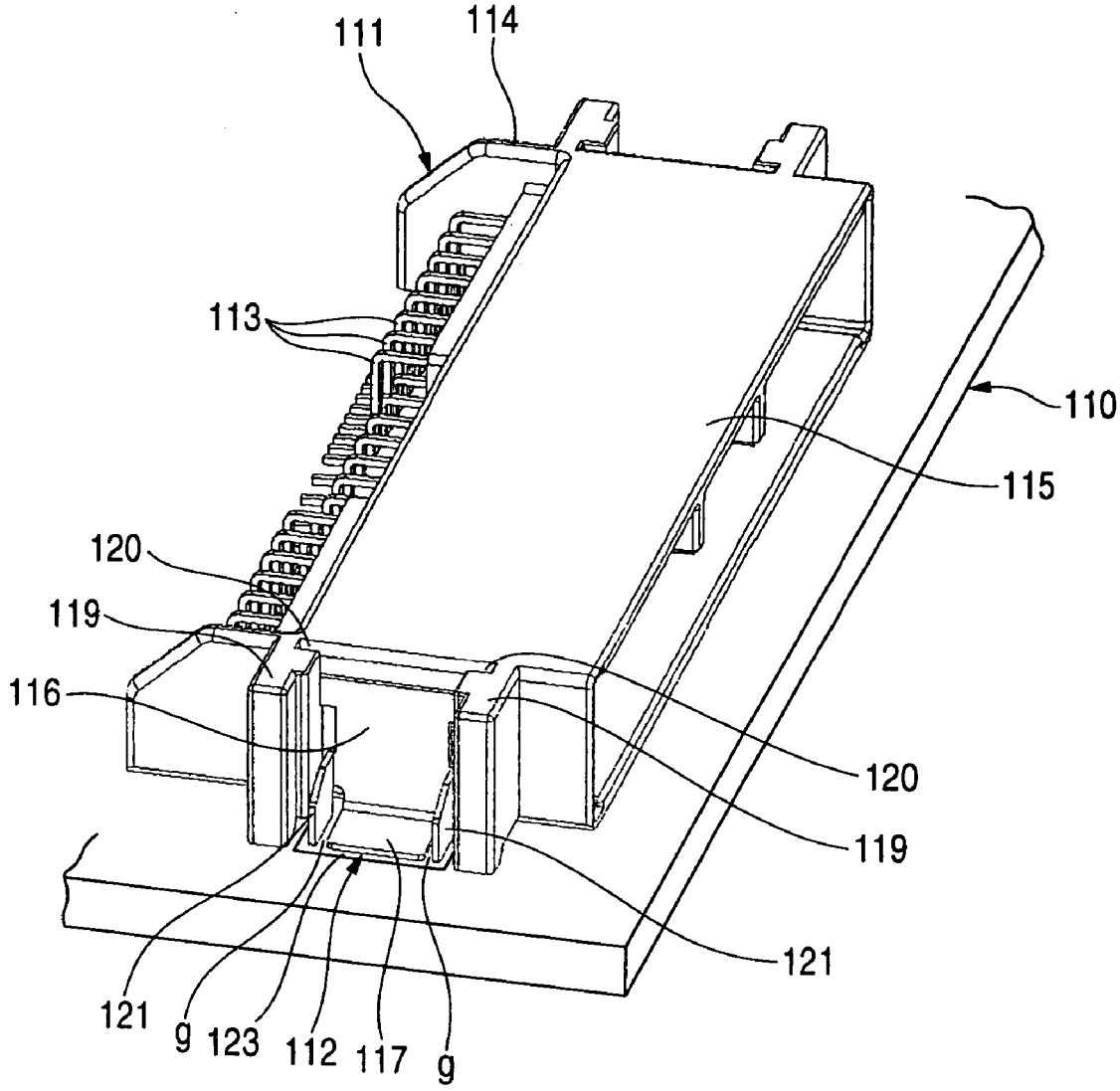
FIG. 7 is a perspective view of a first embodiment of a connector fixing structure of the present invention.
Figure 8:
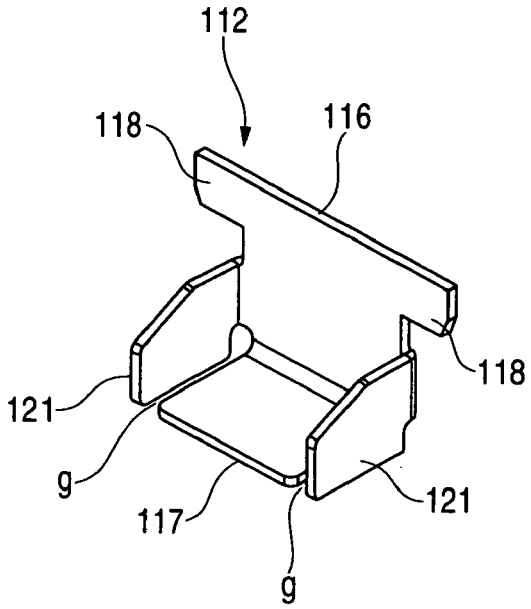
FIGS. 8A and 8B are perspective views showing a fixing metal member as seen from different angles, respectively.
Figure 8:
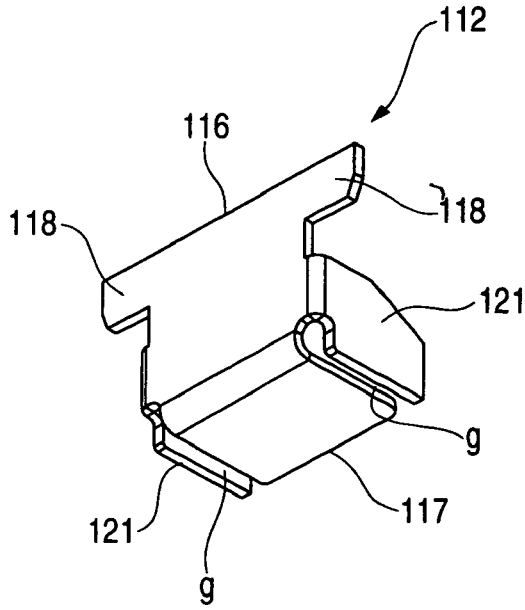
Figure 9:
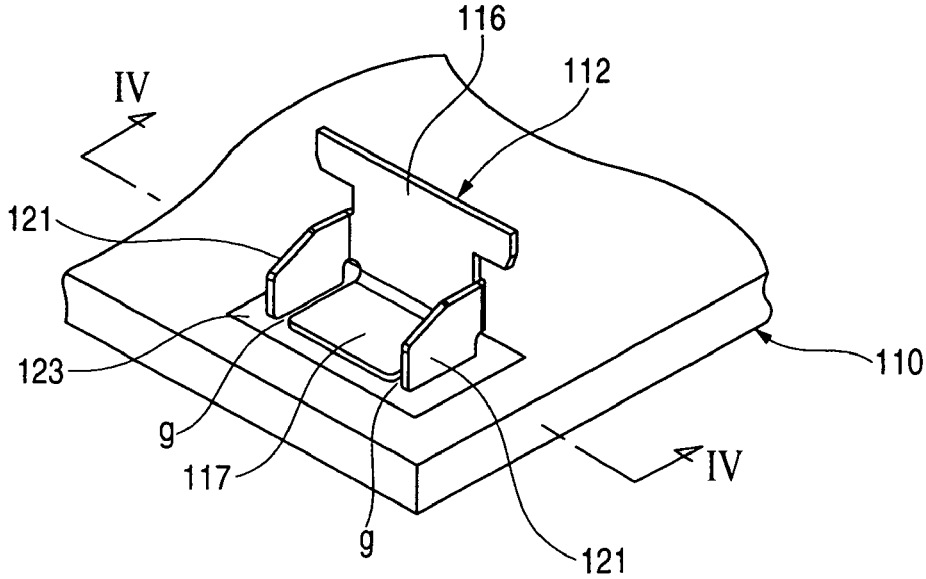
FIG. 9 is a perspective view showing the mounting of the fixing metal member on a land.
Figure 10:
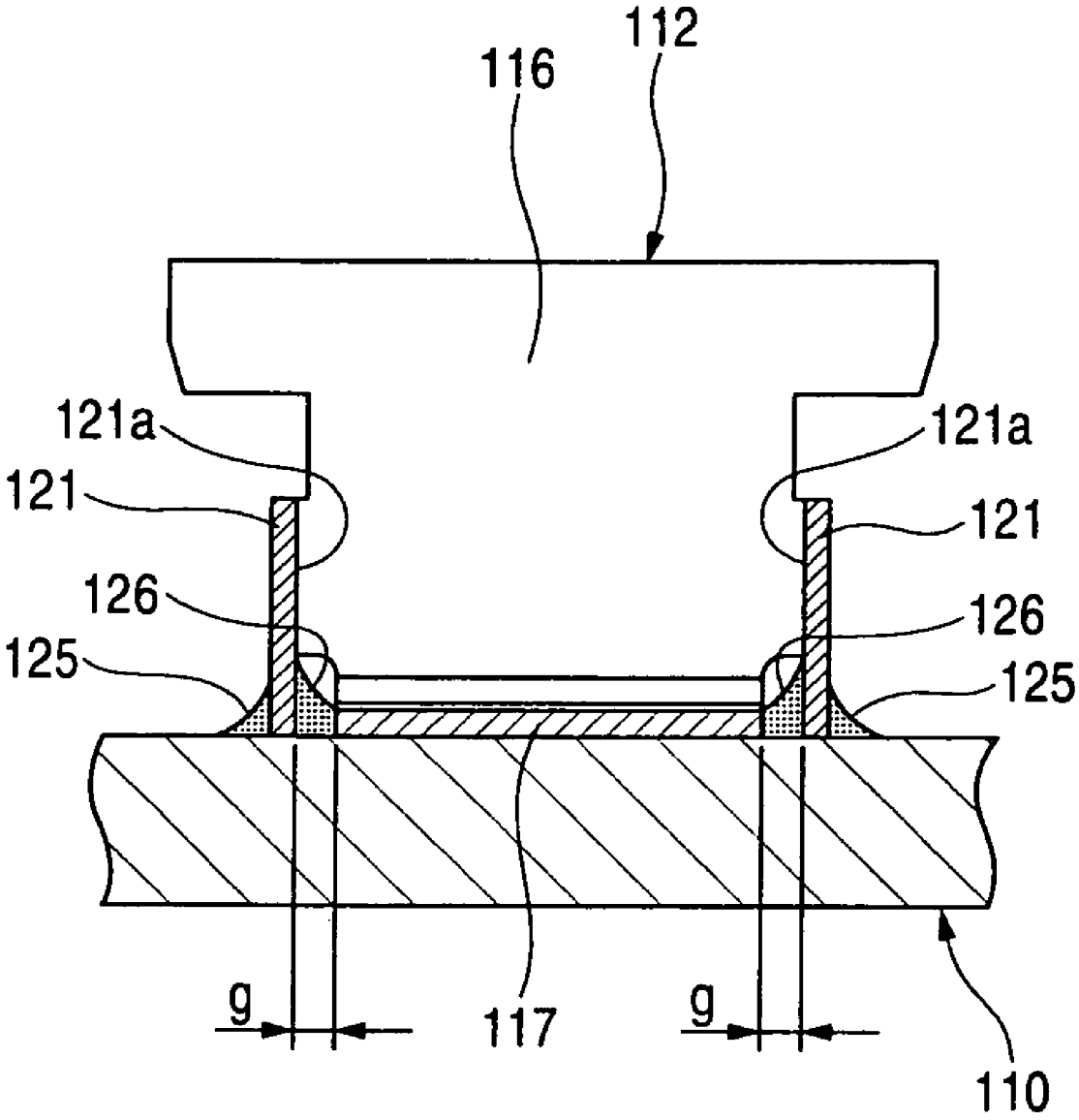
FIG. 10 is a cross-sectional view taken along the line IV-IV of FIG. 9.

FIG. 7 is a perspective view of the second embodiment of the connector fixing structure of the invention, FIGS. 8A and 8B are perspective views showing a fixing metal member, FIG. 9 is a perspective view showing the mounting of the fixing metal member on a land, FIG. 10 is a cross-sectional view taken along the line IV-IV of FIG. 9, FIGS. 11A and 11B are perspective views showing a fixing metal member used in the third embodiment of the connector fixing structure of the invention, FIGS. 12A and 12B are perspective views showing a fixing metal member used in the fourth embodiment of the connector fixing structure of the invention, and FIGS. 13A and 13B are perspective views showing a fixing metal member used in the fifth embodiment of the connector fixing structure of the invention.

FIRST EMBODIMENT

As shown in FIG. 1, the connector fixing structure of this embodiment comprises a pair of fixing metal members 12 for fixing a connector 11 to the board 10.

The connector 11 comprises a plurality of connection terminals 13, and a housing 14 which holds the connection terminals 13 in such a manner that these connection terminals 13 are arranged parallel to one another on an upper surface of the board 10. The housing 14 includes a hood 15 of a generally rectangular tubular shape surrounding contact portions (which can be electrically connected respectively to connection terminals of a mating connector) formed respectively at distal ends of the plurality of connection terminals 13. The mating connector can be inserted into and withdrawn from the hood 15. Connector mounting piece portions 16 of the fixing metal members 12 (described later) are mounted respectively on opposite end surfaces (outer surfaces) of the hood 15 which are disposed generally perpendicular to the upper surface of the board 10.

As shown in FIG. 2, the whole of the fixing metal member 12 is formed by a single-metal sheet or plate, and includes the connector mounting piece portion 16 which is adapted to be disposed generally perpendicular to the upper surface of the board 10, and is adapted to be mounted on the end surface of the hood 15 of the connector 11, and a board joining piece portion 17 which is formed integrally at a lower edge of the connector mounting piece portion 16, and extends therefrom so as to be disposed on the upper surface of the board 10 in parallel relation thereto.

A pair of projecting piece portions 18 are formed respectively at opposite side edges of an upper end portion of the connector mounting piece portion 16. On the other hand, a pair of vertically-extending ribs 19 and 19 are formed on each of the opposite end surfaces (on which the respective connector mounting piece portions 16 are adapted to be mounted) of the hood 15 of the connector 11. A pair of engagement grooves 20 are formed respectively in opposed inner surfaces of the two ribs 19 and 19, and the projecting piece portions 18 of the connector mounting piece portion 16 can be inserted respectively into the pair of engagement grooves 20 from the upper side. The connector mounting piece portion 16 is inserted between the pair of ribs 19 and 19 from the upper side, and the pair of projecting piece portions 18 and 18 are received respectively in the pair of engagement grooves 20, and by doing so, the connector mounting piece portion 16 can be mounted on the end surface of the hood 15.

The fixing metal member 12 has an insertion piece portion 21 which is formed by stamping out part of the board joining piece portion 17 and then by bending this stamped-out portion. The insertion piece portion 21 is a small piece portion formed through a generally U-shaped slit formed in the board joining piece portion 17, and this small piece portion is bent at generally right angles relative to the board joining piece portion 17 (which is to be disposed on the upper surface of the board 10 in parallel relation thereto) so as to be disposed perpendicular to the board 10. Opposite ends of the generally U-shaped slit extend into a bent portion 22 interconnecting the board joining piece portion 17 and the connector mounting piece portion 16, and the insertion piece portion 21 extends downwardly (or depends) from the lower edge of the connector mounting piece portion 16.

As shown in FIGS. 4 and 5, the board joining piece portion 17 is soldered to the land 23 formed on the upper surface of the board 10. The land 23 is formed into a size slightly larger than a size of the board joining piece portion 17 so that molten solder spreads in a generally tapering manner from an outer peripheral edge of the board joining piece portion 17 to form a fillet 25. As shown in FIG. 3, a hole portion 24 is formed in the land 23, and the insertion piece portion 21 of the fixing metal member 12 is inserted into this hole portion 24. The hole portion 24 extends through the board 10 in the upward-downward direction.

As shown in FIG. 2, a rib-like convex portion 29 is formed on the insertion piece portion 21, and is disposed at a widthwise central portion of the insertion piece portion 21, and extends from a proximal end of the insertion piece portion 21 (connected to the lower edge of the connector mounting piece portion 16) toward a distal end thereof, that is, to a region near to this distal end (In other words, the convex portion 29 terminates short of this distal end.). The convex portion 29 is formed by beating out part of the insertion piece portion 21, for example, by pressing or the like. In this embodiment, the convex portion 29 extends to be formed also on the connector mounting piece portion 16. When the insertion piece portion 21 is inserted in the hole portion 24 as shown in FIG. 5, a clearance between the insertion piece portion 21 and the hole portion 24 is made small by the convex portion 29 projecting from one side (or surface) of the insertion piece portion 21 in the direction of the thickness thereof, and more specifically a gap between an inner surface of the hole portion 24 and the other side (or surface) of the insertion piece portion 21, facing away from the convex portion 29, is made so small that a capillary action can develop in this gap.

A suitable amount of solder is beforehand provided on the land 23, and the board joining piece portion 17 is placed on the land 23 and in this condition the solder is suitably heated and cooled, and by doing so, the board joining piece portion 17 is soldered to the land 23. At this time, the molten solder penetrates into the gap between the surface of the insertion piece portion 21 and the inner surface of the hole portion 24, and the insertion piece portion 21 is soldered to the hole portion 24.

The molten solder, penetrating into the gap between the insertion piece portion 21 and the inner surface of the hole portion 24, spreads from the distal end or edge of the insertion piece portion 21 toward the bottom (or lower end) of the hole portion 24, that is, spreads downwardly in a generally tapering manner, to form a fillet 26. As compared with the case where the insertion piece portion 21 is not formed, the area of joining of the solder to the board 10 is increased by an amount corresponding to the fillet 26, and therefore the strength of joining of the solder to the board 10 is increased, and therefore the strength of joining of the fixing metal member 12 to the board 10 through the solder is increased.

Also, the solder creeps up a peripheral edge of a void portion (or hole) 27, formed in the board joining piece portion 17 as a result of stamping out the insertion piece portion 21, to form a fillet 28 at this peripheral edge. Therefore, as compared with the case where the insertion piece portion 21 is not formed, the area of joining of the solder to the fixing metal member 12 is increased by an amount corresponding to the fillet 28, and therefore the strength of joining of the solder to the fixing metal member 12 is increased, and therefore the strength of joining of the fixing metal member 12 to the board 10 through the solder is increased.

Thus, in the connector fixing structure of this embodiment, the insertion piece portion 21 is stamped out of the board joining piece portion 17, and is bent, and this insertion piece portion 21 is inserted into the hole portion 24 in the land 23, and is soldered to the hole portion 24. By doing so, the strength of joining of the fixing metal member 12 to the board 10 through the solder can be increased, and therefore the sufficient strength of fixing of the connector 11 to the board 10 can be secured. Here, the insertion piece portion 21 is stamped out of the board joining piece portion 17, and is bent, and therefore the area, occupied by the board joining piece portion 17 on the board 10, will not become larger as compared with the case where the insertion piece portion 21 is not formed.

And besides, when the fixing metal member 12, mounted on the connector 11, is inserted into the hole portion 24 formed in the land 23, the positioning of the connector 11 relative to the board 10 can be effected. Namely, the insertion piece portion 21 and the hole portion 24 cooperate with each other to function as positioning means. This is desirable in the case where any positioning bosses are not provided because of a compact size of the connector.

Furthermore, the convex portion 29 is formed on the insertion piece portion 21 so as to reduce the clearance between the insertion piece portion 21 and the hole portion 24. With this construction, a capillary action is caused to develop in the gap between the surface of the insertion piece portion 21 and the inner surface of the hole portion 24 so that the molten solder can easily penetrate to the distal end of the insertion piece portion 21, and besides when the connector 11 is positioned relative to the board 10 by the insertion piece portion 21 and the hole portion 24, a relative movement between the connector 11 and the board 10 can be made small.

Furthermore, the convex portion 29 is formed on other portion of the insertion piece portion 21 than the distal end portion thereof, and therefore when reducing the clearance between the hole portion 24 and the insertion piece portion 21 (inserted in this hole portion 24) by the convex portion 29, the easy insertion of the insertion piece portion 21 into the hole portion 24 can be effected.

The present invention is not limited to the above embodiment, and suitable modifications can be made without departing from the subject matter of the invention.

SECOND EMBODIMENT

As shown in FIG. 7, the connector fixing structure of this embodiment comprises a pair of fixing metal members 112 for fixing a connector 111 to a board 110.

The connector 111 comprises a plurality of connection terminals 113, and a housing 114 which holds the connection terminals 113 in such a manner that these connection terminals 113 are arranged parallel to one another on an upper surface of the board 110. The housing 114 includes a hood 115 of a generally rectangular tubular shape surrounding contact portions (which can be electrically connected respectively to connection terminals of a mating connector) formed respectively at distal ends of the plurality of connection terminals 113. The mating connector can be inserted into and withdrawn from the hood 115. Connector mounting piece portions 116 of the fixing metal members 112 (described later) are mounted respectively on opposite end surfaces (outer surfaces) of the hood 115 which are disposed generally perpendicular to the upper surface of the board 110.

As shown in FIG. 8, the whole of the fixing metal member 112 is formed by a single metal sheet or plate, and includes the connector mounting piece portion 116 which is adapted to be disposed generally perpendicular to the upper surface of the board 110, and is adapted to be mounted on the end surface of the hood 115 of the connector 111, and a board joining piece portion 117 which is formed integrally at a lower edge of the connect or mounting piece portion 116, and extends therefrom so as to be disposed on the upper surface of the board 110 in parallel relation thereto.

A pair of projecting piece portions 118 are formed respectively at opposite side edges of an upper end portion of the connector mounting piece portion 116. On the other hand, a pair of vertically-extending ribs 119 and 119 are formed on each of the opposite end surfaces (on which the respective connector mounting piece portions 116 are adapted to be mounted) of the hood 115 of the connector 111. A pair of engagement grooves 120 are formed respectively in opposed inner surfaces of the two ribs 119 and 119, and the projecting piece portions 118 of the connector mounting piece portion 116 can be inserted respectively into the pair of engagement grooves 120 from the upper side. The connector mounting piece portion 116 is inserted between the pair of ribs 119 and 119 from the upper side, and the pair of projecting piece portions 118 and 118 are received respectively in the pair of engagement grooves 120, and by doing so, the connector mounting piece portion 116 can be mounted on the end surface of the hood 115.

The fixing metal member 112 further includes a pair of small piece portions 121 and 121 which are adapted to disposed in an upstanding condition on the upper surface of the board 110 in perpendicular relation thereto. The small piece portions 121 and 121 are formed respectively by bending small piece portions, extending respectively from opposite side edges of the connector mounting piece portion 116, at generally right angles in such a manner that these bent small piece portions extend respectively along opposite side edges of the board joining piece portion 117. A small gap g is formed between a lower edge portion of each small piece portion 121 and the corresponding side edge of the board joining piece portion 117.

As shown in FIGS. 9 and 10, the board joining piece portion 117 and the small piece portions 121 and 121 are integrally soldered to the land 123 formed on the upper surface of the board 110. A suitable amount of solder is beforehand provided on the 101 and 123, and the board joining piece portion 117 and the small piece portions 121 and 121 are placed on the land 123, and in this condition the solder is suitably heated and cooled, and by doing so, the board joining piece portion 117 and the small piece portions 121 and 121 are soldered to the land 123.

The land 123 is formed into a size slightly larger than a size of the outer shape including the board joining piece portion 117 and the small piece portions 121 and 121, and the molten solder spreads in a generally tapering manner from outermost peripheral edges of the board joining piece portion 117 and small piece portions 121 and 121 to form fillets 125.

Further, the molten solder penetrates into the gaps g each formed between the side edge of the board joining piece portion 117 and the lower edge portion of the small piece portion 121. Each small piece portion 121 has a height larger than the height (thickness) of the side edge of the board joining piece portion 117, and the molten solder, penetrating into the gap g, spreads to creep up an inner surface 121*a* of the small piece portion 121 to form a fillet 126. As compared with the case where the small piece portions 121 are not formed, the area of joining of the solder to the fixing metal member 112 is increased by an amount corresponding to the fillets 126, and therefore the strength of joining of the solder to the fixing metal member 112 is increased, and therefore the strength of joining of the fixing metal member 112 to the board 10 through the solder is increased.

Thus, in the connector fixing structure of this embodiment, the small piece portions 121 and 121, disposed upright on the board 110 with the small gap g formed between each small piece portion 121 and the corresponding side edge of the board joining piece portion 117, are integrally soldered, together with the board joining piece portion 117, to the land 123, and as a result the molten solder penetrates into the gaps g each formed between each small piece portion 121 and the corresponding side edge of the board joining piece portion 117, and spreads to creep up the small piece portions 121 and 121 to form the fillets 126 having the sufficient height from the board 110. As compared with the case where the small piece portions 121 are not formed, the area of joining of the solder to the fixing metal member 112 is increased by an amount corresponding to the fillets 126, and therefore the strength of joining of the solder to the fixing metal member 112 is increased, and therefore the strength of joining of the fixing metal member 112 to the board 110 through the solder can be increased.

Here, each small piece portion 121 is in the form of a thin sheet, and each gap g, formed between the lower edge portion of the small piece portion 121 and the side edge of the board joining piece portion 117, is also small, and therefore the area, occupied by the board joining piece portion 117 (and hence the area occupied by the fixing metal member 112) on the board 110, is almost the same as that obtained when the small piece portions 121 are not formed.

THIRD EMBODIMENT

Next, the third embodiment of the connector fixing structure of the invention will be described with reference to FIG. 11. The connector fixing structure of this embodiment differs from the connector fixing structure of the above first embodiment only in the shape of the fixing metal member, and the other members are identical to those of the first embodiment, and therefore explanation thereof will be omitted. Further, those portions of the fixing metal member of this embodiment, identical to those of the fixing metal member 112 of the second embodiment, will be designated respectively by like or corresponding reference numerals so as to simplify the description.

Figure 11:
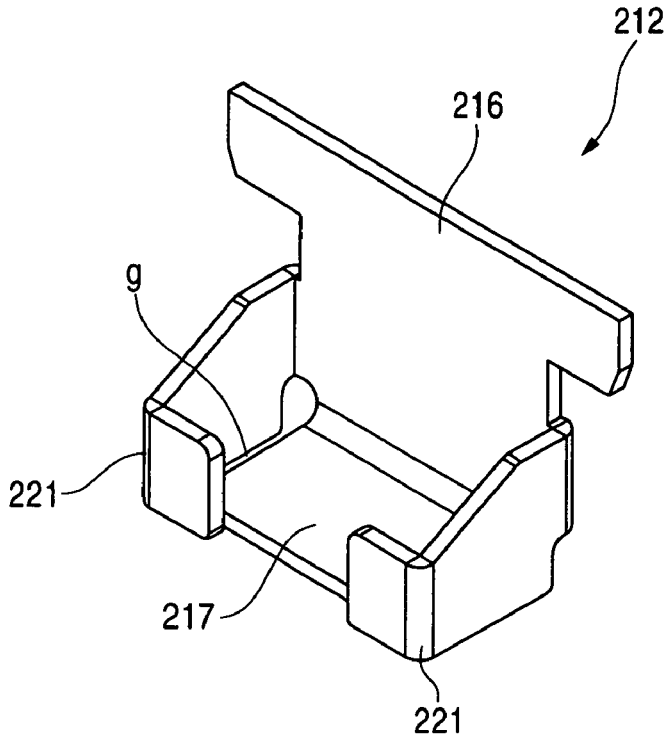
FIGS. 11A and 11B are perspective views of a fixing metal member used in a second embodiment of a connector fixing structure of the invention, showing this fixing metal member as seen from different angles, respectively.
Figure 11:
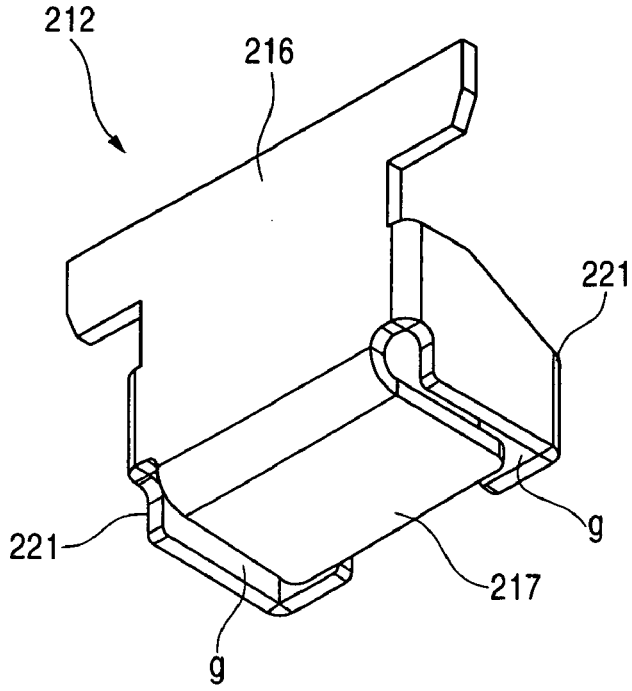

As shown in FIG. 11, the fixing metal member 212, used in the connector fixing structure of this embodiment, includes a connector mounting piece portion 216 which is adapted to be disposed generally perpendicular to an upper surface of a board 110, and is adapted to be mounted on an end surface of a hood 115 of a connector 111, and a board joining piece portion 217 which is formed integrally at a lower edge of the connector mounting piece portion 216, and extends therefrom so as to be disposed on the upper surface of the board 110 in parallel relation thereto.

The fixing metal member 212 further includes a pair of small piece portions 221 and 221 which are adapted to disposed in an upstanding condition on the upper surface of the board 110 in perpendicular relation thereto. The small piece portions 221 and 221 are formed respectively by bending small piece portions, extending respectively from opposite side edges of the connector mounting piece portion 216 in such a manner that these bent small piece portions extend respectively along opposite side edges of the board joining piece portion 217 and then by bending distal end portions of these small piece portions in such a manner that these distal end portions extend along a front edge of the board joining piece portion 217. A small gap g is formed between a lower edge portion of each small piece portion 221 and a peripheral edge portion of the board joining piece portion 217 including the corresponding side edge thereof and the front edge thereof.

The board joining piece portion 217 and the small piece portions 221 and 221 are integrally soldered to a land 123 formed on the upper surface of the board 110. Molten solder penetrates into the gaps g each formed between the peripheral edge portion of the board joining piece portion 217 (including the side edge thereof and the front edge) and the lower edge portion of the small piece portion 221. Each small piece portion 221 has a height larger than the thickness of the board joining piece portion 217, and the molten solder, penetrating into the gap g, spreads upwardly from the corresponding side edge and the front edge of the board joining piece portion 217, and creeps up an inner surface of the small piece portion 221 to form a fillet.

In this embodiment, the area of joining of the solder to the fixing metal member 212 is increased by an amount corresponding to those portions of the fillets each formed between the front edge of the board joining piece portion 217 and the inner surface of the distal end portion of the corresponding small piece portion 221, as compared with the fixing metal member 112 of the second embodiment. Therefore the strength of joining of the solder to the fixing metal member 212 is further increased, and therefore the strength of joining of the fixing metal member 212 to the board 110 through the solder can be further increased.

FOURTH EMBODIMENT

Next, the third embodiment of the connector fixing structure of the invention will be described with reference to FIG. 12. The connector fixing structure of this embodiment differs from the connector fixing structure of the above second embodiment only in the shape of the fixing metal member, and the other members are identical to those of the second embodiment, and therefore explanation thereof will be omitted. Further, those portions of the fixing metal member of this embodiment, identical to those of the fixing metal member 112 of the second embodiment, will be designated respectively by like or corresponding reference numerals so as to simplify the description.

Figure 12:
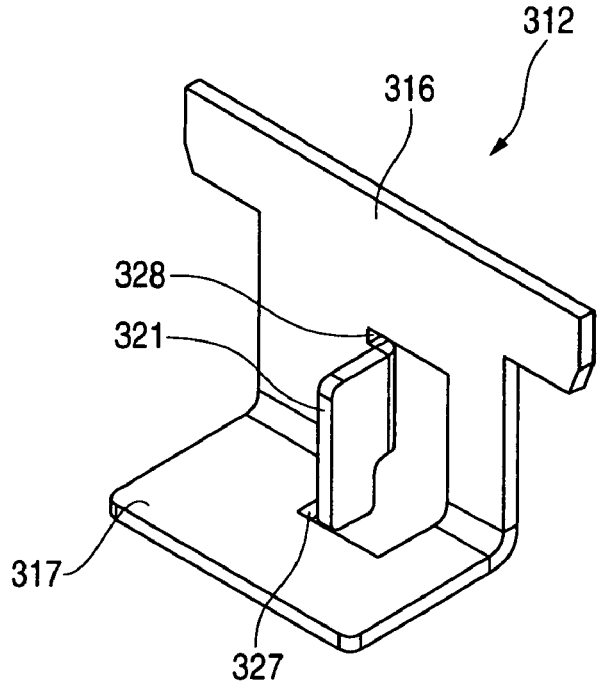
FIGS. 12A and 12B are perspective views of a fixing metal member used in a third embodiment of a connector fixing structure of the invention, showing this fixing metal member as seen from different angles, respectively.
Figure 12:
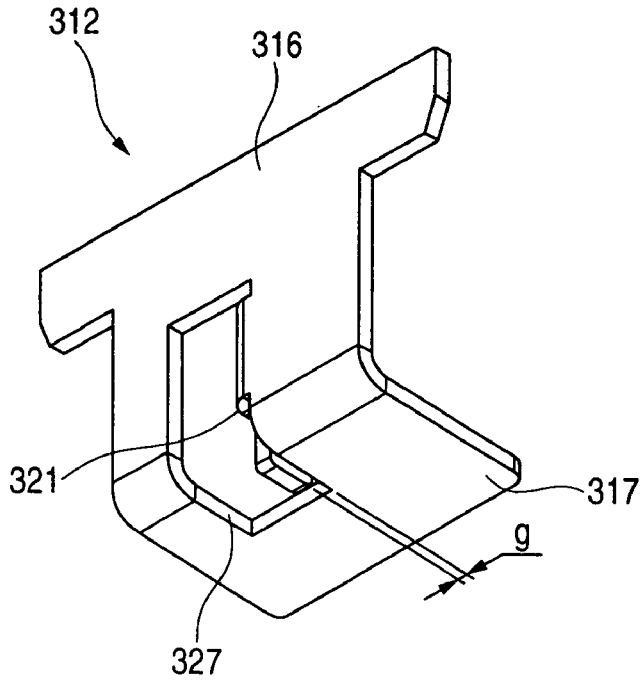

As shown in FIG. 12, the fixing metal member 312, used in the connector fixing structure of this embodiment, includes a connector mounting piece portion 316 which is adapted to be disposed generally perpendicular to an upper surface of a board 110, and is adapted to be mounted on an end surface of a hood 115 of a connector 111, and a board joining piece portion 317 which is formed integrally at a lower edge of the connector mounting piece portion 316, and extends therefrom so as to be disposed on the upper surface of the board 110 in parallel relation thereto. A notch 327 of a generally rectangular shape is formed in the board joining piece portion 317 intermediate opposite side edges thereof (which are spaced from each other in a direction of a width thereof), and extends from a rear edge of the board joining piece portion 317 (where the board joining piece portion 317 and the connector mounting piece portion 316 are interconnected) toward a front edge thereof, the notch 327 extending through the board joining piece portion 317 in a direction of a thickness thereof.

The fixing metal member 312 further includes a small piece portion 321 which is adapted to disposed in an upstanding condition on the upper surface of the board 110 in perpendicular relation thereto. The small piece portion 221 is formed by a small piece portion (or a section) separated from the connector mounting piece portion 316 by a generally L-shaped slit 328, formed in this connector mounting piece portion 316 in continuous relation to the notch 327 in the board joining piece portion 317, in such a manner that one side edge of the small piece portion is kept connected to the connector mounting piece portion 316. This section (small piece portion) is bent at its side edge connected to the connector mounting piece portion 316, and is directed toward the board joining piece portion 317 to form the small piece portion 321. A lower edge portion of the small piece portion 321 is disposed within the notch 327 in the board joining piece portion 317, and a small gap g is formed between the lower edge portion of the small piece portion 321 and an inner edge of the notch 327.

The board joining piece portion 317 and the small piece portion 321 are integrally soldered to a land 123 formed on the upper surface of the board 110. Molten solder penetrates into the gaps g formed between the inner edge of the notch 327 (formed in the board joining piece portion 317) and the lower edge portion of the small piece portion 321. The small piece portion 321 has a height larger than the thickness of the board joining piece portion 317, and the molten solder, penetrating into the gap, spreads upwardly from the inner edge of the notch 327 in the board joining piece portion 317, and creeps up a side surface of the small piece portion 321 to form a fillet.

This embodiment is similar to the second embodiment in that the sufficient height of the fillet is secured through the small piece portion 321 disposed upright on the board 110, thereby increasing the strength of joining of the solder to the fixing metal member 312. However, the small piece portion 321 is disposed within the notch 327 in the board joining piece portion 317, and therefore there can be avoided a situation in which the area, occupied by the board joining piece portion 317 (and hence the area occupied by the fixing metal member 312) on the board 110 increases.

FIFTH EMBODIMENT

Next, the fifth embodiment of the connector fixing structure of the invention will be described with reference to FIG. 13. The connector fixing structure of this embodiment differs from the connector fixing structure of the above fourth embodiment only in the shape of the fixing metal member, and the other members are identical to those of the fourth embodiment, and therefore explanation thereof will be omitted. Further, those portions of the fixing metal member of this embodiment, identical to those of the fixing metal member 312 of the fourth embodiment, will be designated respectively by like or corresponding reference numerals so as to simplify the description.

Figure 13:
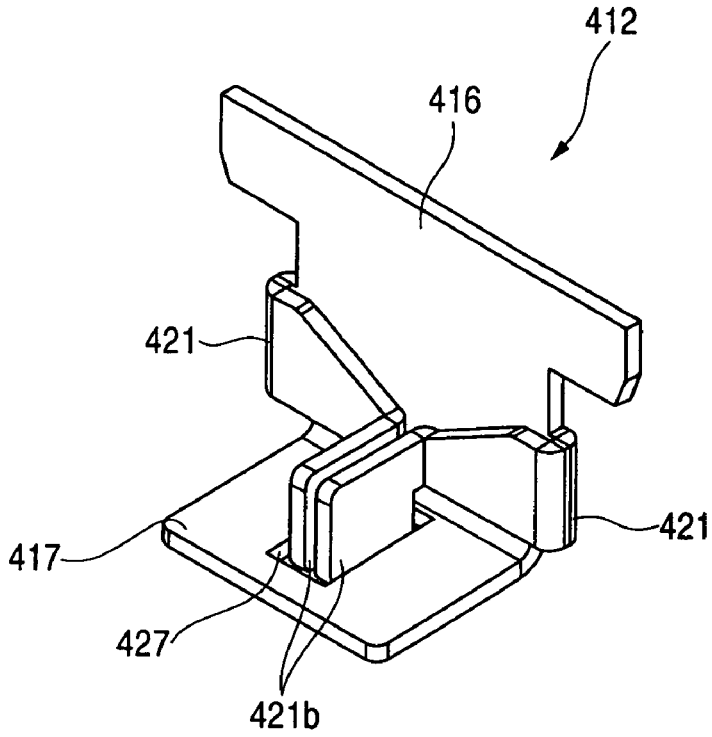
FIGS. 13A and 13B are perspective views of a fixing metal member used in a fourth embodiment of a connector fixing structure of the invention, showing this fixing metal member as seen from different angles, respectively.
Figure 13:
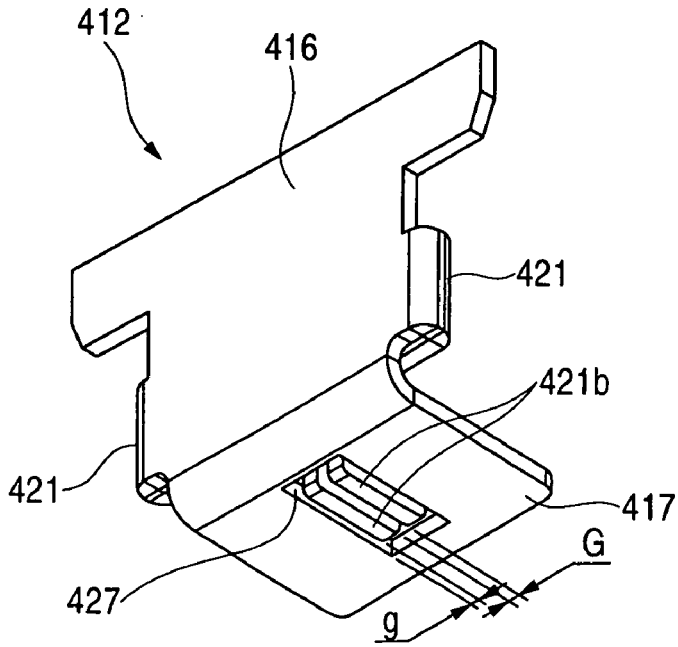

As shown in FIG. 13, the fixing metal member 412, used in the connector fixing structure of this embodiment, includes a connector mounting piece portion 416 which is adapted to be disposed generally perpendicular to an upper surface of a board 110, and is adapted to be mounted on an end surface of a hood 115 of a connector 111, and a board joining piece portion 417 which is formed integrally at a lower edge of the connector mounting piece portion 416, and extends therefrom so as to be disposed on the upper surface of the board 110 in parallel relation thereto. A notch 427 of a generally rectangular shape is formed in a central portion of the board joining piece portion 417, the notch 427 extending through the board joining piece portion 417 in a direction of a thickness thereof.

The fixing metal member 412 includes small piece portions 421 and 421, and these small piece portions 421 and 421 are formed respectively by bending back small piece portions, extending respectively from opposite side edges of the connector mounting piece portion 416, in such a manner that these bent small piece portions extend toward each other and that distal end portions of these bent small piece portions are further bent at a widthwise-central portion of the connector mounting piece portion 416, and are directed toward a front edge of the board joining piece portion 417. Each of the small piece portions 421 and 421 has a depending portion 421*b* formed on and extending downwardly from the distal end portion thereof into the notch 427 in the board joining piece portion 417. These depending portions 421*b*, received within the notch 427, are adapted to be disposed in an upstanding condition on the upper surface of the board 110 in perpendicular relation thereto. A small gap g is formed between a lower edge portion of the depending portion 421*b* of each of the small piece portions 421 and an inner edge of the notch 427. A small gap G is also formed between the two depending portions 421*b* and 421*b*.

The board joining piece portion 417 and the small piece portions 421 and 421 are integrally soldered to a land 123 formed on the upper surface of the board 110. Molten solder penetrates into each gaps g formed between the inner edge of the notch 427 (formed in the board joining piece portion 417) and the lower edge portion of the depending portion 421*b* of the small piece portion 421. Each small piece portion 421 has a height larger than the thickness of the board joining piece portion 417, and the molten solder, penetrating into each gap g, spreads upwardly from the inner edge of the notch 427 in the board joining piece portion 417, and creeps up a side surface of the depending portion 421*b* of the small piece portion 421 to form a fillet. The molten solder also penetrates into the gap B formed between the two depending portions 421*b* and 421*b*, and spreads to creep up the opposed side surfaces of the two depending portions 421*b* and 421*b* to form a fillet.

This embodiment is similar to the third embodiment in that the depending portions 421*b* of the small piece portions 421 (which serve to secure the sufficient height of the fillets) are disposed within the notch 427 in the board joining piece portion 417, thereby avoiding a situation in which the area, occupied by the fixing metal member 412 on the board 110, increases. However, the depending portions 421*b* of the plurality of the small piece portions 421 are disposed within the notch 427 in the board joining piece portion 417 to generally fill in this notch 427. The fillet is formed between the inner edge of the notch 427 and the depending portion 421*b* of each of the plurality of small piece portions 421, and also the fillet is formed between the plurality of depending portions 421*b*. Thus, a larger number of fillets are formed, thereby increasing the area of joining of the solder to the fixing metal member 412. As a result, the strength of joining of the solder to the fixing metal member 412 can be further increased, and therefore the strength of joining of the fixing metal member 412 to the board 110 through the solder can be further increased.

The present invention is not limited to the above embodiments, and suitable modifications can be made without departing from the subject matter of the invention.

What is claimed is:

1. A connector fixing structure, comprising:
- a board, to which a connector is fixed, including;
  - a land, formed on the board, and
  - a hole, formed in the land,
- a fixing metal member, including;
  - a first piece, attached to the connector, and
  - a second piece, continued from the first piece so as to be disposed on and in parallel to the board, and adapted to be soldered to the land; and
  - a third piece, formed by stamping out and bending a part of the second piece, inserted into the hole, and soldered to the hole.

2. The connector fixing structure according to claim 1, wherein a convex portion is formed on the third piece so as to reduce a clearance between the hole and the third piece.

3. The connector fixing structure according to claim 2, wherein the convex portion is formed on other portion of the third piece than a distal end portion of the third piece.

4. A connector fixing structure, comprising:
- a board, to which a connector is fixed; including,
  - a land formed on the board,
- a fixing metal member, including;
  - a first piece, attached to the connector, and
  - a second piece, continued from the first piece so as to be disposed on and in parallel to the board, and is adapted to be soldered to; and
  - a third piece, disposed in an upstanding condition on the board, with a small gap formed between the third piece portion and an edge of the second piece, and soldered to said land together with the second piece.

5. The connector fixing structure according to claim 1, wherein a notch is formed in the second piece, and the third piece is disposed within the notch, with the small gap formed between the third piece and an inner edge of the notch.

* * * * *